US009118152B2

(12) United States Patent
Ho

(10) Patent No.: US 9,118,152 B2
(45) Date of Patent: Aug. 25, 2015

(54) ELECTRICAL CONNECTOR

(71) Applicant: Molex Incorporated, Lisle, IL (US)

(72) Inventor: Yi-Tse Ho, Taipei (TW)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 14/364,964

(22) PCT Filed: Dec. 13, 2012

(86) PCT No.: PCT/US2012/069554

§ 371 (c)(1),
(2) Date: Jun. 12, 2014

(87) PCT Pub. No.: WO2013/090608

PCT Pub. Date: Jun. 20, 2013

(65) Prior Publication Data

US 2014/0370752 A1 Dec. 18, 2014

(30) Foreign Application Priority Data

Dec. 14, 2011 (TW) ..... 100223584 U
Dec. 15, 2011 (TW) ..... 100223672 U

(51) Int. Cl.
*H01R 13/648* (2006.01)
*H01R 12/71* (2011.01)
*H01R 13/6594* (2011.01)
(Continued)

(52) U.S. Cl.
CPC ..... *H01R 12/714* (2013.01); *H01R 13/642* (2013.01); *H01R 13/6594* (2013.01); *H01R 12/722* (2013.01)

(58) Field of Classification Search
CPC .. H01R 12/714; H01R 12/722; H01R 13/642; H01R 13/6594
USPC ..... 439/607.35–607.37, 607.4
See application file for complete search history.

(56) References Cited

U.S. PATENT DOCUMENTS 7,467,977 B1 12/2008 Yi et al.
7,540,784 B1 6/2009 Zhang et al.
(Continued)

FOREIGN PATENT DOCUMENTS

TW M361742 U 7/2009
TW M381186 U 5/2010
(Continued)

OTHER PUBLICATIONS

International Search Report for PCT/US2012/069554.

*Primary Examiner* — Khiem Nguyen
(74) *Attorney, Agent, or Firm* — Stephen L. Sheldon

(57) ABSTRACT

An electrical connector includes an insulative housing, a plurality of terminals, and a metal shell. The insulative housing has a body portion, two tongues, and a polarizing portion, the body portion has a mating face and a rear end face opposite to the mating face, the two tongues are spaced apart from each other and protrude forwardly from the mating face and are arranged side-by-side along a horizontal direction. In an embodiment the metal shell surrounds the two tongues so as to define an inserting port and a polarizing portion is recessed downwardly from the top wall and is positioned between the two tongues, and a latching arm is bent from the bottom wall and is provided with a latching hole engaged with the retaining portion of the insulative housing. In an embodiment, the metal shell includes a strengthen tab protruding from the bottom wall.

20 Claims, 13 Drawing Sheets

(51) Int. Cl.
*H01R 13/642* (2006.01)
*H01R 12/72* (2011.01)

(56) References Cited

U.S. PATENT DOCUMENTS

| | | | |
|---|---|---|---|
| 7,909,633 | B1 | 3/2011 | Miller et al. |
| 2003/0017744 | A1 | 1/2003 | Shao |
| 2007/0149053 | A1 | 6/2007 | Wan et al. |
| 2011/0300748 | A1 | 12/2011 | Song et al. |

FOREIGN PATENT DOCUMENTS

| | | |
|---|---|---|
| TW | M390571 | 10/2010 |
| TW | M393089 U | 11/2010 |
| TW | M400112 U | 3/2011 |
| TW | M406287 U | 6/2011 |

ELECTRICAL CONNECTOR

RELATED APPLICATION

This application claims priority to Taiwan Patent No. M432969, filed Dec. 14, 2011 and to Taiwan Patent No. M432989, filed Dec. 15, 2011, both of which are incorporated herein by reference in their entirety.

FIELD OF THE INVENTION

The present invention relates to an electrical connector, and more particularly to an electrical connector with improved structural strength.

DESCRIPTION OF RELATED ART

For a receptacle electrical connector which generally comprises a cage, a conventional cage is mostly formed by bending a metal sheet and defines an inserting port, and thus an engaging seam will be generated. In order to prevent the cage from being cracked and deformed at the engaging seam after plugging of the receptacle electrical connector many times, it is desirable to strengthen a structure of the cage.

Taking an electrical connector disclosed by Taiwan utility model patent publication No. TWM400112 as an example, a cage of the electrical connector comprises an upper shell and a lower shell, the upper shell comprises a top wall and two side walls extending from two opposite ends of the top wall in the same direction, and end portions of the two side walls are respectively extended with inserting portions, the lower shell comprises a flat-plate portion, a plurality of inserting holes through which the inserting portions of the upper shell pass are correspondingly provided in the flat-plate portion. The electrical connector is disposed on a circuit board, the flat-plate portion of the upper shell is positioned on and supported by the circuit board, and the inserting portions of the upper shell pass through the inserting holes of the flat-plate portion and is received and supported by the circuit board, by means of which the cage is prevent from being cracked and deformed.

However, the structure of the cage as described previously must depend on support of the circuit board so as to attain an effect that the cage is prevent from being cracked and deformed, which is not suitable for the sinking-type electrical connector. Therefore, there still is an improvement room on how to strengthen the structure of the cage so as to be suitable for the sinking-type electrical connector.

As is known, one known design of electrical connector is a configuration having two tongues horizontally arranged side-by-side. In order to avoid the improper insertion of a mating connector (e.g., backward installation) when a user inserts a mating electrical connector into the electrical connector, which would result in terminals that would not be properly connected and thus would not provide the desired signal transmission function), an polarizing element would be provided between the two tongues so as to avoid the previous phenomenon occurring. For example, Taiwan utility model patent publication No. TWM390571 discloses an electrical connector receptacle which comprises a metal ring-shape shell and an insulative housing provided in the shell, a front end surface of the insulative housing is formed with two tongues extending forwardly and spaced apart from each other and a guiding portion, and the guiding portion is positioned between the two tongues. The guiding portion is the element for polarizing.

Because the guiding portion extends forwardly out from the insulative housing, is an elongate shape and is made of plastic, while connected to the mating electrical connector, a front end of the guiding portion would be suffered to an insertion force first and is easily swayed, and thus there is a risk of being broken. Thus, certain individuals would appreciate further improvements in electrical connectors.

BRIEF SUMMARY

In an embodiment, an electrical connector includes an insulative housing, a plurality of terminals, and a cage. The insulative housing has a body portion, two tongues, and a polarizing portion, the body portion has a mating face and a rear end face opposite to the mating face, the two tongues are spaced apart from each other and protrude forwardly from the mating face and are arranged side-by-side along a horizontal direction, the polarizing portion protrudes forwardly from the mating face and is positioned between the two tongues, the polarizing portion is further provided with a receiving groove extending in a front-rear direction. The terminals are provided to the insulative housing and mounted to the two tongues. The cage is engaged with the body portion of the insulative housing and surrounds the two tongues so as to define an mating port, the cage has a top wall, a bottom wall opposite to the top wall, two side walls respectively connected to two sides of the top wall and the bottom wall and a reinforcement tab protruding from the bottom wall, the reinforcement tab is correspondingly received in the receiving groove In another embodiment, an electrical connector includes an insulative housing, a plurality of terminals, and a cage. The insulative housing comprises a body portion, two tongues arranged side-by-side along a horizontal direction, and a retaining portion, the body portion has a mating face and a rear end face opposite to the mating face, the two tongues protrude forwardly from the mating face, and the retaining portion is formed in the mating face. The terminals are fixed to the insulative housing and mounted on the two tongues. The cage comprises a top wall, a bottom wall, and two side walls respectively connected to two sides of the top wall and the bottom wall, the cage is formed by stamping and bending a metal sheet and an engaging seam is formed in the bottom wall. The cage surrounds the two tongues so as to define an inserting port, a polarizing portion is recessed downwardly from the top wall and is positioned between the two tongues, and a latching arm is bended from the bottom wall, the latching arm is provided with a latching hole engaged with the retaining portion of the insulative housing. Furthermore, the cage further comprises a plurality of fixing legs bended downwardly from a rear end of the top wall.

BRIEF DESCRIPTION OF THE DRAWINGS

The present invention is illustrated by way of example and not limited in the accompanying figures in which like reference numerals indicate similar elements and in which.

DETAILED DESCRIPTION

Figure 1:
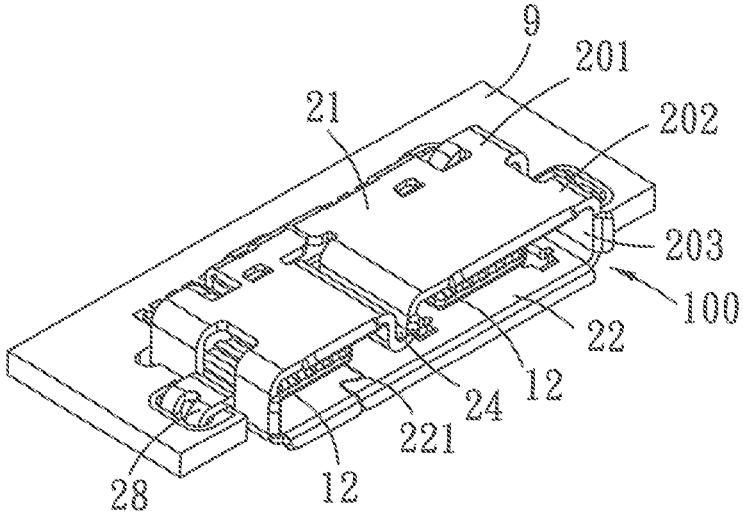
FIG. 1 is a perspective view illustrating that an electrical connector of a preferred embodiment of the present application is mounted to a circuit board.
Figure 2:
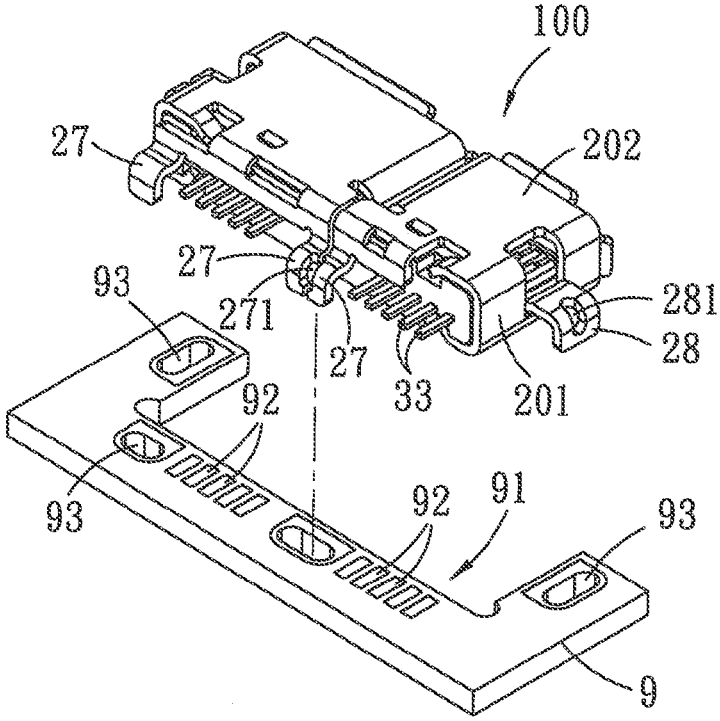
FIG. 2 is an exploded view of FIG. 1.
Figure 3:
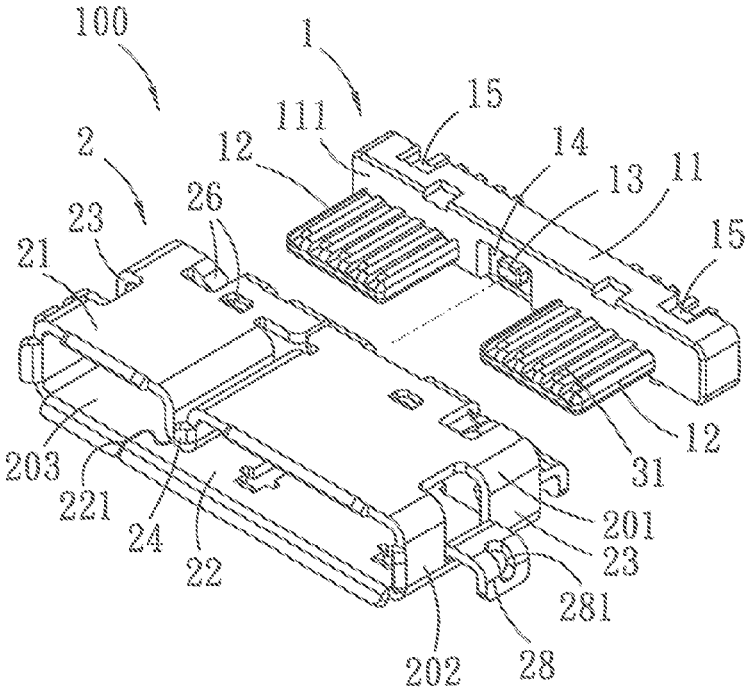
FIG. 3 is an exploded perspective view of the present preferred embodiment.
Figure 4:
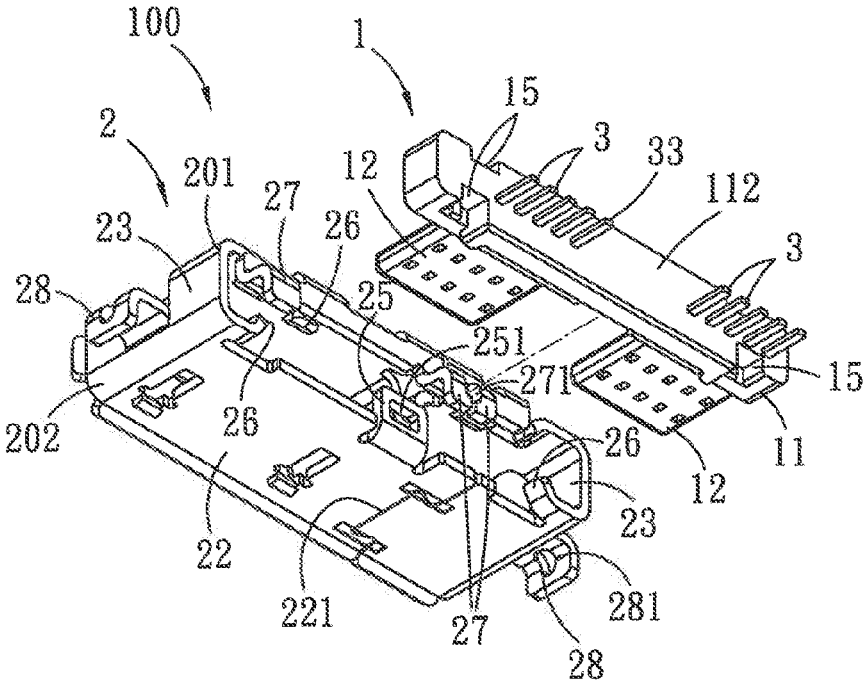
FIG. 4 is a view of FIG. 3 viewed from another view angle.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

Benefits of the embodiments depicted herein include the fact that the cage may be fixed by means of engaging the latching arm connected to the bottom wall and the latching hole with the retaining portion of the insulative housing so as to strengthen the structural strength of the bottom wall, which can prevent the bottom wall of the electrical connector from being cracked and deformed after plugging many times, and particularly suitable for a sinking-type electrical connector. Moreover, the fixing legs extending from the rear end of the top wall of the cage are also beneficial to strengthen structural strengths of the top wall and the polarizing portion. In addition, in an embodiment the reinforcement tab of metal material is positioned in the polarizing portion and close to the front side, the electrical connector may greatly strengthen structural strength of the polarizing portion and may prevent the front end of the polarizing portion from being swayed due to suffered force so as to prevent the polarizing portion from being broken.

Referring to FIGS. 1-4, an electrical connector 100 of a preferred embodiment of the present application is suitable to mount to a circuit board 9 having a cutout 91, and the electrical connector 100 comprises an insulative housing 1, a cage 2, and a plurality of terminals 3.

The insulative housing 1 comprises a body portion 11, two tongues 12 arranged side-by-side along a horizontal direction, and a retaining portion 13. The body portion 11 has a mating face 111 facing forwardly and a rear end face 112 opposite to the mating face 111, the two tongues 12 protrude forwardly from the mating face 111, and the retaining portion 13 is formed in the mating face 111. In the present preferred embodiment, the retaining portion 13 is preferably positioned between the two tongues 12, the mating face 111 of the body portion 11 is recessed rearwardly with a recessed portion 14 surrounding the retaining portion 13 therein, a lower end of the recessed portion 14 is open at a bottom surface of the body portion 11, a front surface of the retaining portion 13 is substantially flush with the mating face 111 of the insulative housing 11 and thus protrudes forwardly relative to the recessed portion 14. However, in another embodiment, the retaining portion may also be a protrusion (not illustrated) protruding forwardly directly from the mating face 111 of the body portion 11, a front surface of the retaining portion protrudes more forwardly relative to the mating face 111.

Figure 7:
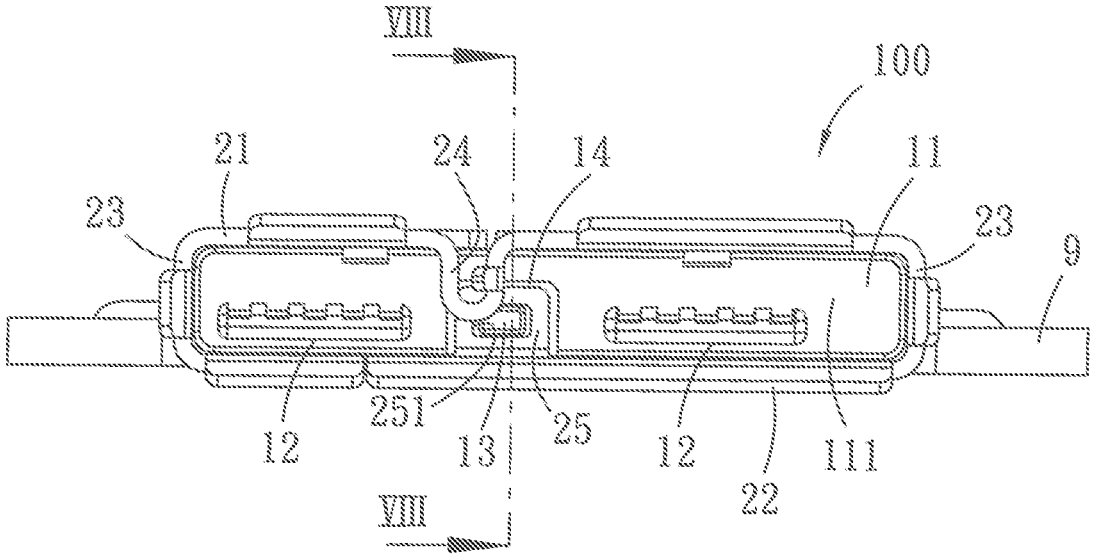
FIG. 7 is a front view of FIG. 1.
Figure 8:
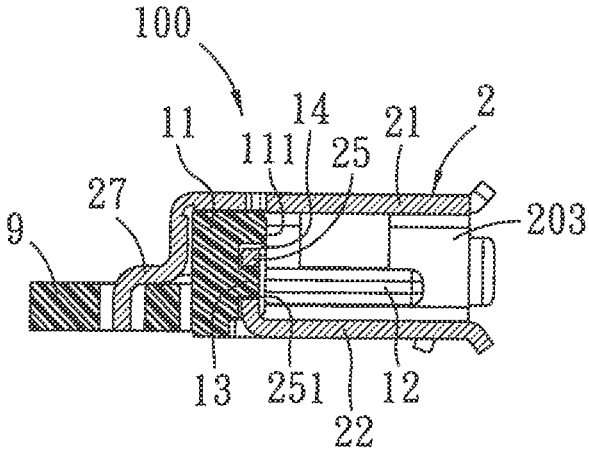
FIG. 8 is a sectional view taken along a line VIII-VIII of FIG. 7.

The cage comprises a top wall 21, a bottom wall 22, and two side walls 23 respectively connected to two sides of the top wall 21 and the bottom wall 22, the cage 2 is formed by stamping and bending a metal sheet and an engaging seam 221 is formed in the bottom wall 22. A rear portion 201 of the cage 2 is engaged with the body portion 11 of the insulative housing 1, and a front portion 202 of the cage 2 surrounds the two tongues 12 so as to define an inserting port 203, a polarizing portion 24 is recessed downwardly from the top wall 21 and is positioned between the two tongues 12, and a latching arm 25 extends from the bottom wall 22, the latching arm 25 is provided with a latching hole 251 engaged with the retaining portion 13 of the insulative housing 1 (referring to FIG. 7 and FIG. 8). In the present preferred embodiment, the latching arm 25 is preferably bended upwardly from a rear end of the bottom wall 22 (however in another embodiment, the latching arm 25 may also bended rearwardly from a front end of the bottom wall 22 then extend upwardly), the latching hole 251 is preferably defined in a middle portion of the latching arm 25 in a manner of penetrating in a front-rear direction, and a periphery of the latching hole 251 is closed so as to increase structural strength of the latching arm 25. The latching arm 25 of the cage 2 is received in the recessed portion 14 of the insulative housing 1, and the retaining portion 13 can be protrudingly received in the latching hole 251 of the latching arm 25, the front surfaces of the retaining portion 13 and the latching arm 25 are preferably substantially flush with the mating face 111 of the insulative housing 1 and slightly recessed rearwardly, so that it is beneficial to reduce a whole length of the electrical connector 100 and would not affect on insertion of a mating plug (not illustrated) into the inserting port 203. The rear portion 201 of the cage 2 is formed with a plurality of bending tabs 26 at the top wall 21 and the bottom wall 22, and the body portion 11 of the insulative housing 1 is provided with a plurality of engaging slots 15 respectively receiving corresponding bending tabs 26, thereby engaging, positioning and fixing the cage 2 and the insulative housing 1 relative to each other. Moreover, the cage 2 further comprises three fixing legs 27 bended downwardly from a rear end of the top wall 21, wherein one fixing leg 27 is positioned close to a side edge, two sides of the polarizing portion 24 each has one fixing leg 27 bended downwardly therefrom and these two fixing legs 27 are adjacent side-by-side and together form a catching solder hole 271 therebetween. Furthermore, a fixing leg 28 also protrudes outwardly from each of the two side walls 23 of the cage 2, and each fixing leg 28 is provided with a catching solder hole 281.

Figure 5:
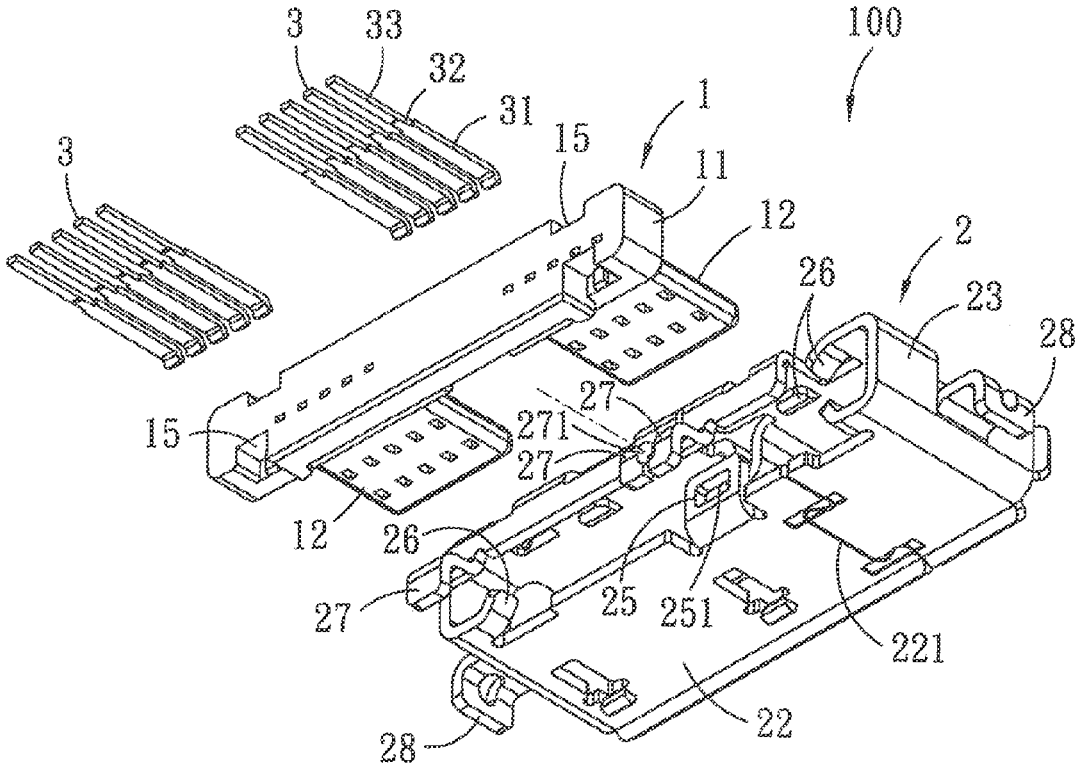
FIG. 5 is a further exploded view of FIG. 3.
Figure 6:
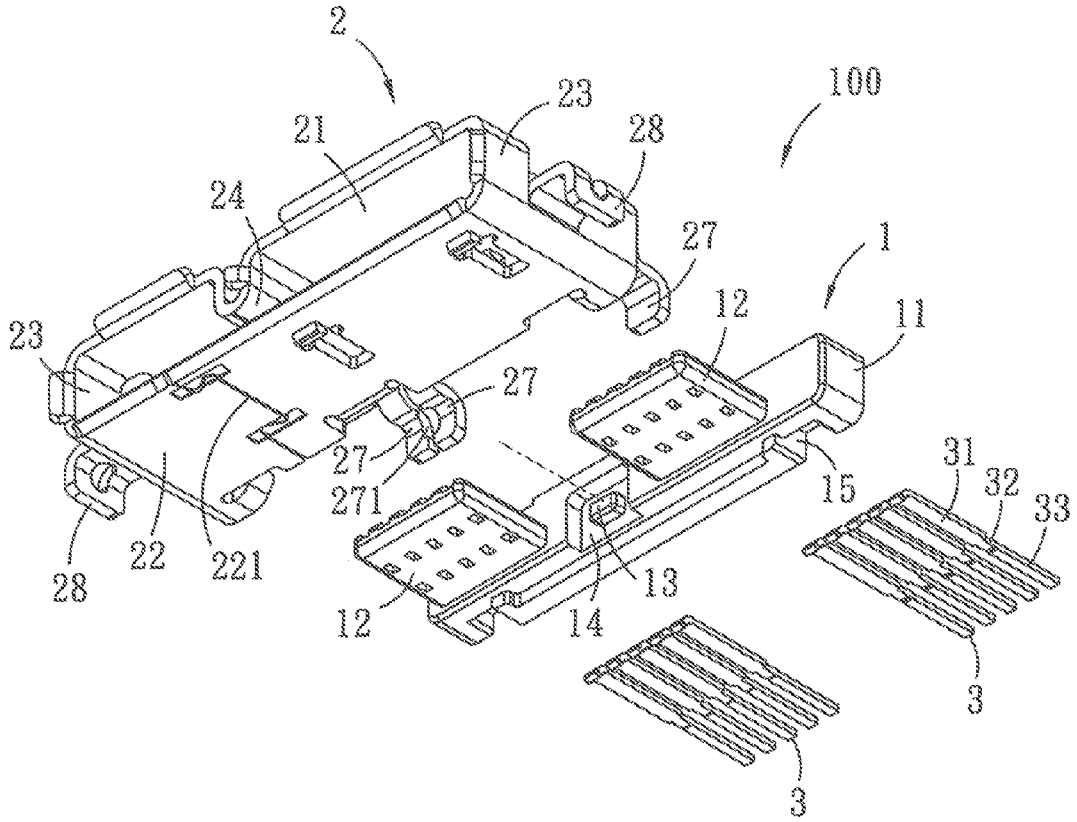
FIG. 6 is a view of FIG. 5 viewed from another view angle.

Referring to FIGS. 3-6, the terminals 3 are fixed to the insulative housing 1 and mounted on the two tongues 12, In the present preferred embodiment, the terminals 3 preferably are integrally formed with the insulative housing 1 by means of an insert molding process, FIG. 5 and FIG. 6 are illustrated as exploded views for sake of convenience of description, in practice, the terminals 3 may be not exploded from the insulative housing 1. Each terminal 3 has a contact portion 31 fixed to the tongue 12, a fixed portion 32 embedded to the insulative housing 1 and a tail portion 33 protruding out of a rear side of the body portion 11. In the present preferred embodiment, the terminals 3 are for transmitting a signal conforming to a Micro-USB3.0 signal transmission specification.

Referring to FIG. 1, FIG. 2, FIG. 7, and FIG. 8, when the electrical connector 100 is mounted to the circuit board 9, the tail portion 33 of each terminal 3 is soldered to a corresponding soldering pad 92 on the circuit board 9, the fixing legs 27, 28 of the cage 2 correspondingly pass through soldering holes 93 in the circuit board 9 and are soldered and fixed to the circuit board 9, engagement force of the fixing legs 27, 28 and the circuit board 9 is increased by means of respective catching solder holes 271, 281, and structural strengths of the top wall 21 and the polarizing portion 24 are strengthened by means of the fixing legs 27 connected to the top wall 21. The bottom wall 22 of the shied shell 2 is suspended within the cutout 91 of the circuit board 9, and is fixed by means of engaging the latching arm 25 connected to the bottom wall 22 and the latching hole 251 with the retaining portion 13, which may strengthen structural strength of the bottom wall 22 and prevent the electrical connector 100 from being cracked and deformed from the engaging seam 221 after plugging many times.

When the electrical connector 100 is manufactured, it is as follows: first fixing the terminals 3 to the insulative housing 1 by using the insert molding process, then sheathing the cage 2 onto the insulative housing 1 from the from toward the rear, making the retaining portion 13 pass through and received in the latching hole 251 of the latching arm 25, finally stamping and forming fixing structures, such as the fixing legs 27 and the tab 26, and the like, and fixing the cage 2 to the insulative housing 1.

In conclusion, the cage 2 of the present preferred embodiment may be fixed by means of engaging the latching arm 25 connected to the bottom wall 22 and the latching hole 251 with the retaining portion 13 of the insulative housing 1 so as to strengthen the structural strength of the bottom wall 22, which can prevent the bottom wall 22 of the electrical connector 100 from being cracked and deformed after plugging many times, and particularly suitable for a sinking-type electrical connector. Moreover, the fixing legs 27 extending from the rear end of the top wall 21 of the cage 2 are also beneficial to strengthen structural strengths of the lop wall 21 and the polarizing portion 24, and cooperate with the fixing legs 28 so as to more stably mount the electrical connector 100 to the circuit board 9.

Referring to FIGS. 9-12, an electrical connector 200' of a second embodiment is suitable to mount to a circuit board 209, the electrical connector 200' comprises an insulative housing 201', a plurality of terminals 202' and a cage 203'.

The insulative housing 201' has a body portion 211, two tongues 212 and a polarizing portion 213. The body portion 211 has a mating face 311 and a rear end face 312 opposite to the mating face 311. The two tongues 212 are spaced apart from each other and protrude forwardly from the mating face 311 and are arranged side-by-side along a horizontal direction, and the polarizing portion 213 protrudes forwardly from the mating face 311 and is positioned between the two tongues 212, the polarizing portion 213 protrudes more forwardly relative to the two tongues 212 and have a bottom surface 331 extending in a front-rear direction, an arc top surface 332 opposite to the bottom surface 331, and two side surfaces 333, 334 respectively connected to two sides of the bottom surface 331 and the top surface 332, wherein one side surface 333 is perpendicular to the bottom surface 331 and the other side surface 334 is oblique to the bottom surface 331 so as to make a width of the bottom surface 331 is more than a width of the top surface 332. The polarizing portion 213 is further provided with a receiving groove 214 extending in the front-rear direction. As depicted, the receiving groove 214 is recessed upwardly from a portion of the bottom surface 331 of the polarizing portion 213 close to a front side and is open at a front end thereof. However in another embodiment (not illustrated), the receiving groove 214 may be recessed upwardly from the bottom surface 331 of the polarizing portion 213 in a manner that allows penetrating in the front to rear direction.

Figure 12:
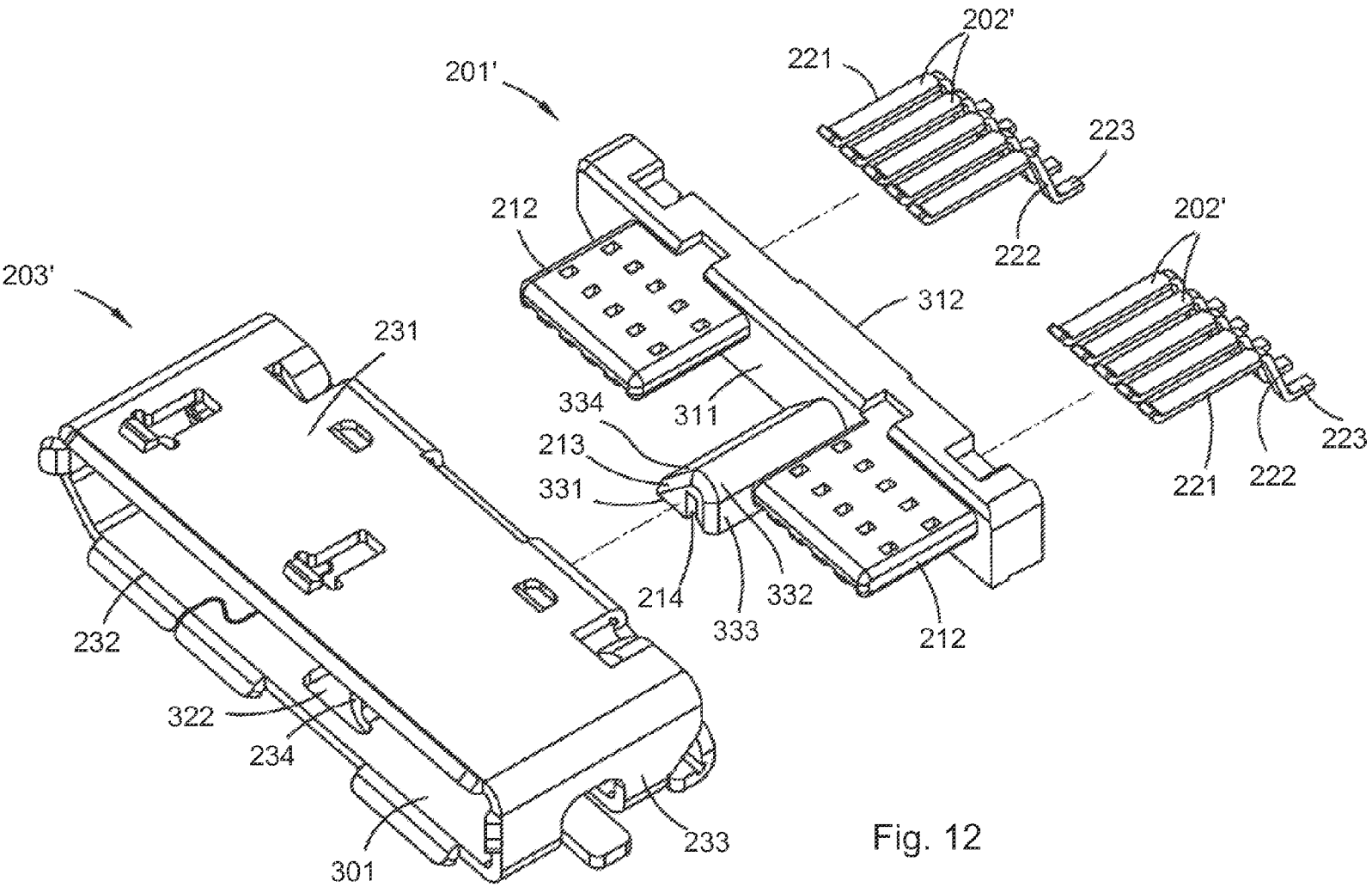
FIG. 12 is a further exploded view of FIG. 10.

The terminals 202' are provided to the insulative housing 201' and mounted to the two tongues 212. As depicted, the terminals 202' are integrally fixed with the insulative housing 201' by means of an insert molding process, FIG. 12 is illustrated as the exploded view for sake of convenience of description. In practice, the terminals 202' may be not exploded from the insulative housing 201'. Each terminal 202' has a contact portion 221' fixed to the tongue 212, a fixed portion 222 embedded to the insulative housing 201 and a tail portion 223 bended from the fixed portion 222 and extending out of the body portion 211 for being soldered to the a corresponding soldering pad 291 on the circuit board 209. In the present preferred embodiment, the terminals 202' are used for transmitting a signal conforming to a Micro-USB 3.0 signal transmission specification.

Figure 15:
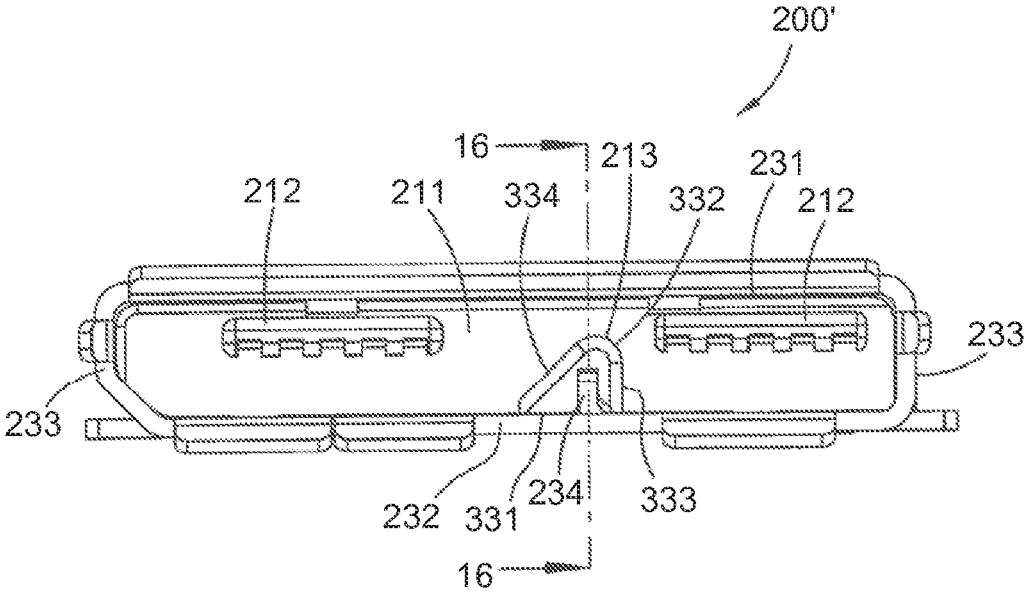
FIG. 15 is a front view of the embodiment depicted in FIG. 9.
Figure 16:
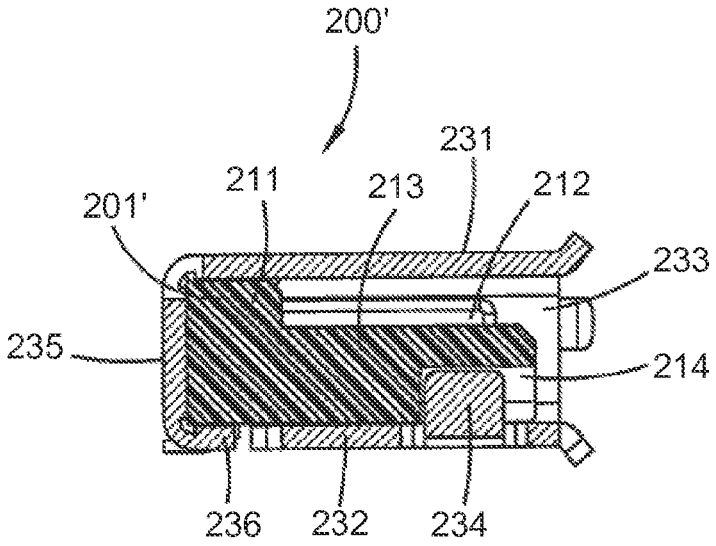
FIG. 16 is a sectional view taken along a line 16-16 of FIG. 15.

The cage 203' is engaged with the body portion 211 of the insulative housing 201' and surrounds the two tongues 212 so as to define a mating port 301. The cage 203' has a top wall 231, a bottom wall 232 opposite to the top wall 231, two side walls 233 respectively connected to two sides of the top wall 231 and the bottom wall 232, and a reinforcement tab 234 protruding inwardly from the bottom wall 232, the reinforcement tab 234 is correspondingly received in the receiving groove 214 (referring to FIG. 15 and FIG. 16). Specifically, the bottom surface 331 of the polarizing portion 213 of the insulative housing 201' is close to the bottom wall 232 of the cage 203, the receiving groove 214 is recessed upwardly from the bottom surface 331 of the polarizing portion 213, the cage 3 is formed by stamping and bending a metal sheet, the reinforcement tab 34 is integrally bended inwardly from a middle portion of the bottom surface 232 and extends toward the mating port 301 and a through hole 322 is formed at this bended position correspondingly. A length of the reinforcement tab 234 in the front-rear direction is more than a width of the reinforcement tab 234 in the horizontal direction, and the reinforcement tab 234 can be correspondingly received in the receiving groove 214. By that the reinforcement tab 234 is positioned in the polarizing portion 213 and is close to the front side, it may substantially increase structural strength of the polarizing portion 213 and may prevent a front end of the polarizing portion 213 from being swayed due to applied force so as to prevent the polarizing portion 213 from being broken.

Figure 9:
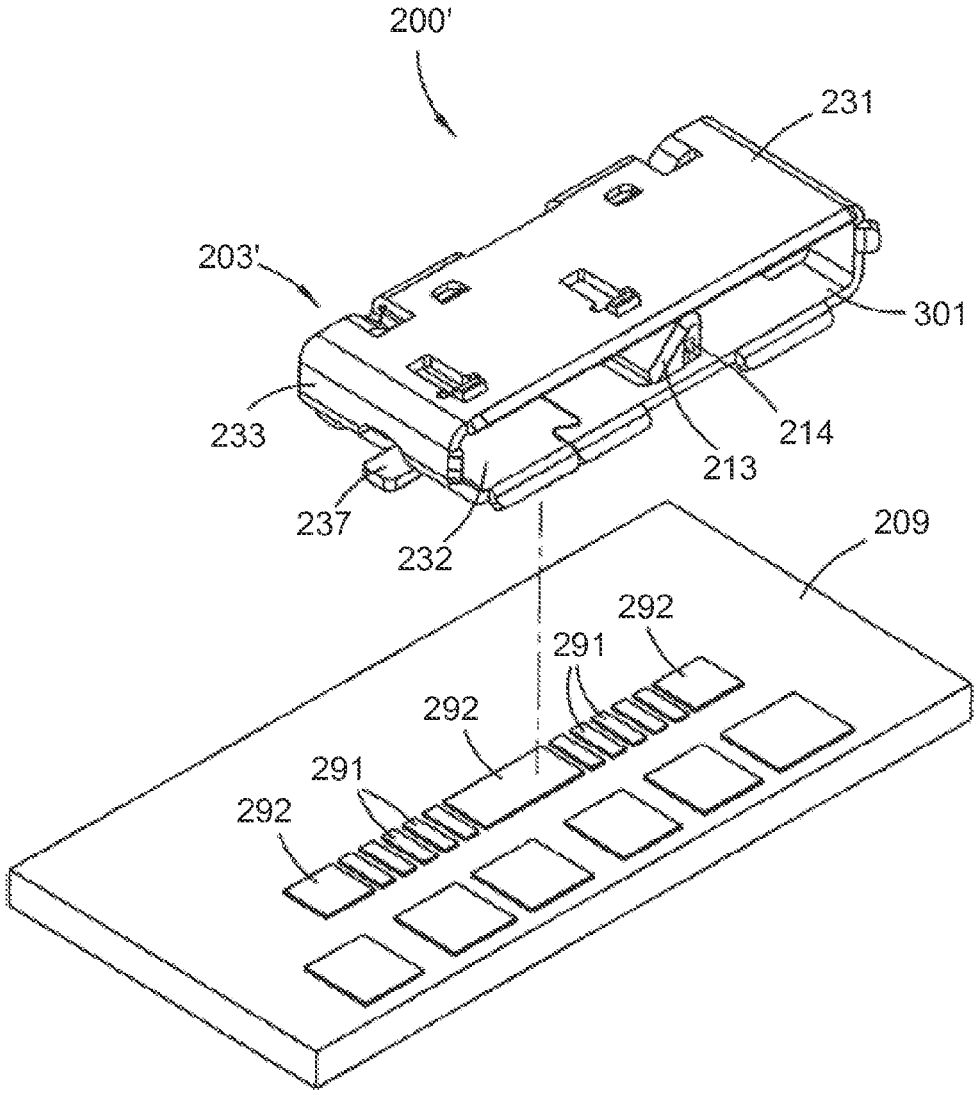
FIG. 9 is a perspective view illustrating an electrical connector of a first preferred embodiment of the present application and a circuit board.
Figure 10:
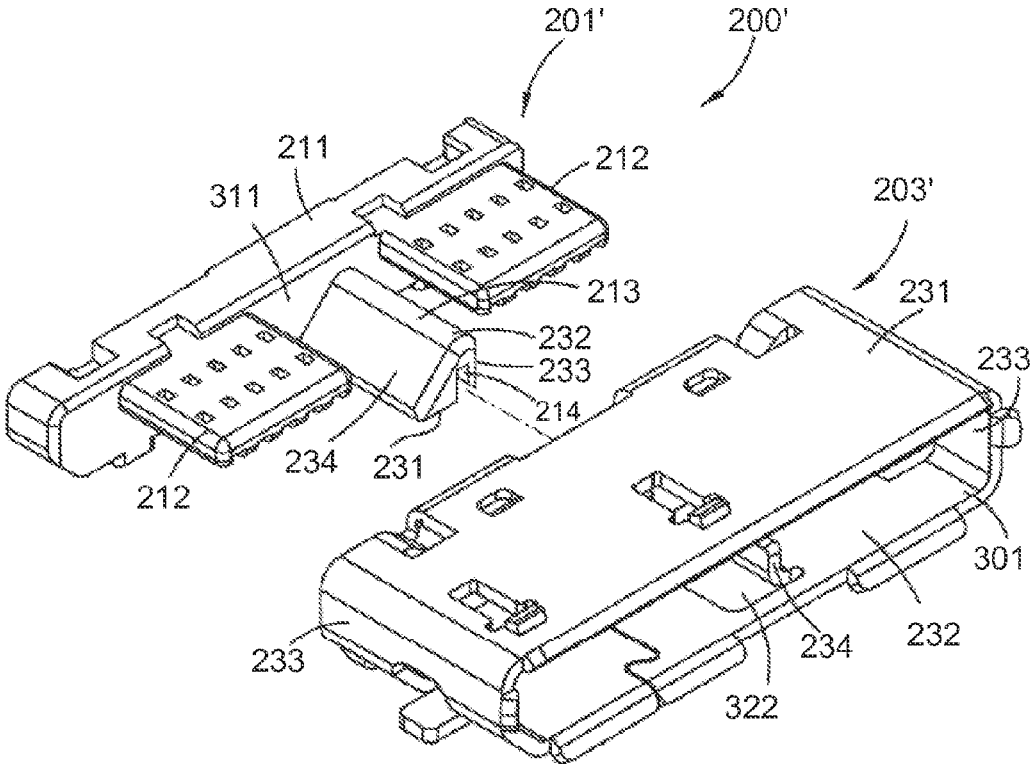
FIG. 10 is an exploded perspective view illustrating the embodiment depicted in FIG. 9.
Figure 11:
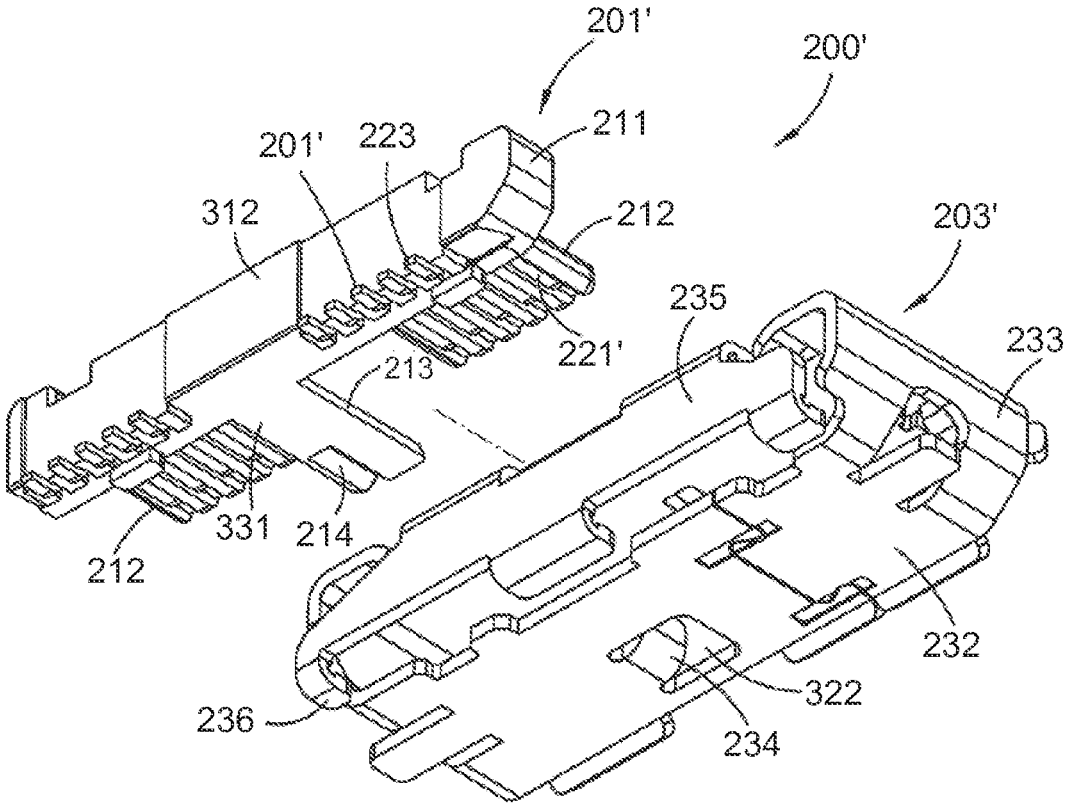
FIG. 11 is a view of FIG. 10 viewed from another view angle.
Figure 13:
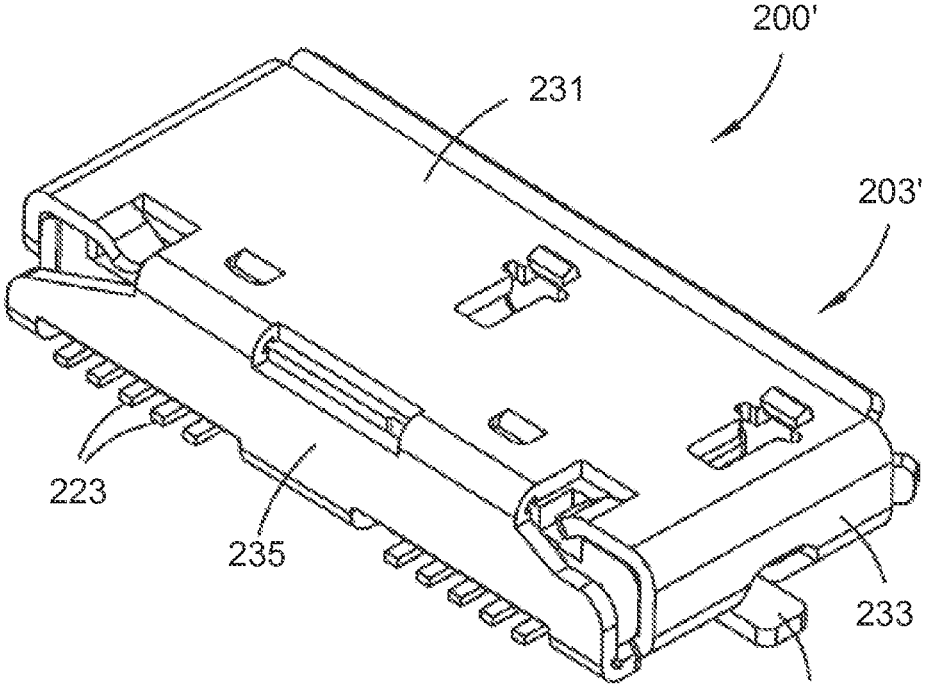
FIG. 13 is a perspective view of the embodiment depicted in FIG. 9.
Figure 14:
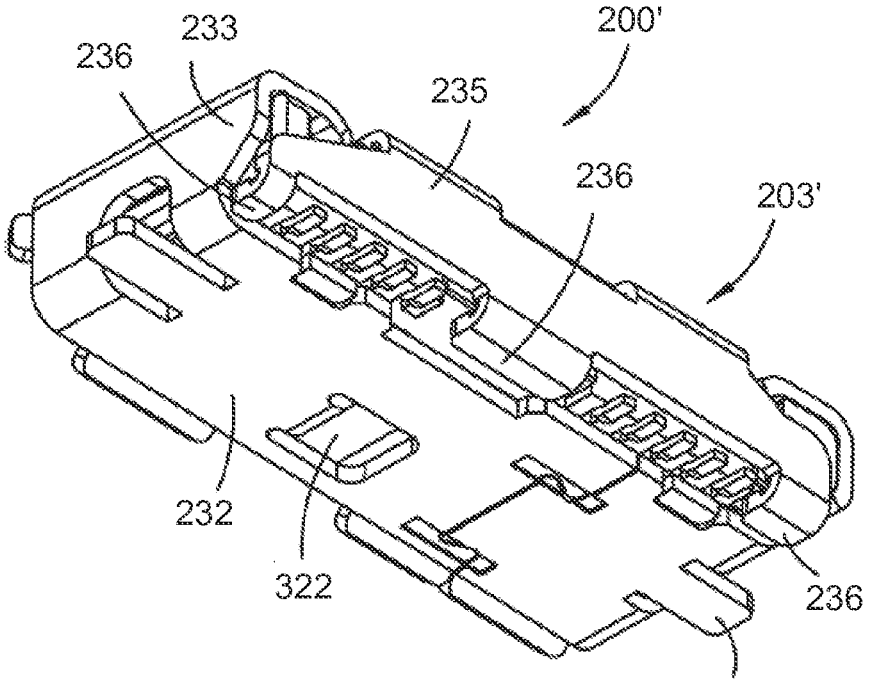
FIG. 14 is another perspective view of the embodiment depicted in FIG. 9 viewed from another view angles

Referring to FIG. 13 and FIG. 14, the cage 203' further has a rear wall 235 bended downwardly from a rear end of the top wall 231 and a plurality of fixing legs 236 extending forwardly from a bottom end of the rear wall 235 for being soldered to corresponding soldering pads 232 on a circuit board 209 (referring to FIG. 9). With the rear wall 235, it may increase a covering area of the cage 203' with respect to the insulative housing 201' and the terminals 202' and thus can increase electro-magnetic shielding effect. Moreover, the bottom wall 232 of the cage 203' is further extended with fixing legs 238 respectively extending toward two sides. The fixing legs 236 extending from the rear wall 235 cooperate with the fixing legs 237 extending from the bottom wall 236 towards the two sides may strengthen soldering engagement strength of the cage 203' and the circuit board 209.

When the electrical connector 200' is manufactured, it can be as follows: first fixing the terminals 202' to the insulative housing 201', then sliding the cage 203' onto the insulative housing 201' from the front toward the rear, making the reinforcement tab 234 inserted into and received in the receiving groove 214 also from the front toward the rear, finally stamping and forming the rear wall 235 and other fixing structures, and fixing the cage 203' to the insulative housing 201' so as to complete assembling.

In conclusion, by that the reinforcement tab 234 of metal material is positioned in the polarizing portion 213 and close to the front side, the electrical connector 200' may greatly strengthen structural strength of the polarizing portion 213 and may prevent the front end of the polarizing portion 213 from being swayed due to suffered force so as to prevent the polarizing portion 213 from being broken. Moreover, with the rear wall 235, it may increase a covering area of the cage 203 with respect to the insulative housing 201' and the terminals 202' and thus can increase electro-magnetic shielding effect. Furthermore, the fixing legs 36 extending from the rear wall 235 cooperate with the fixing legs 237 extending from the bottom wall 232 towards the two sides may strengthen soldering engagement strength of the cage 203' and the circuit board 209.

Figure 17:
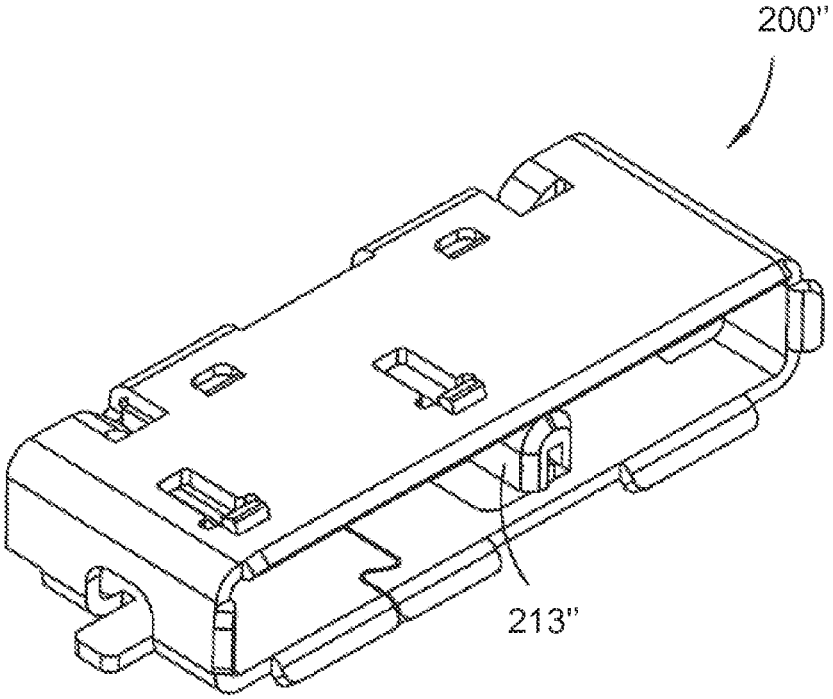
FIG. 17 is a perspective view illustrating another embodiment of an electrical connector.
Figure 18:
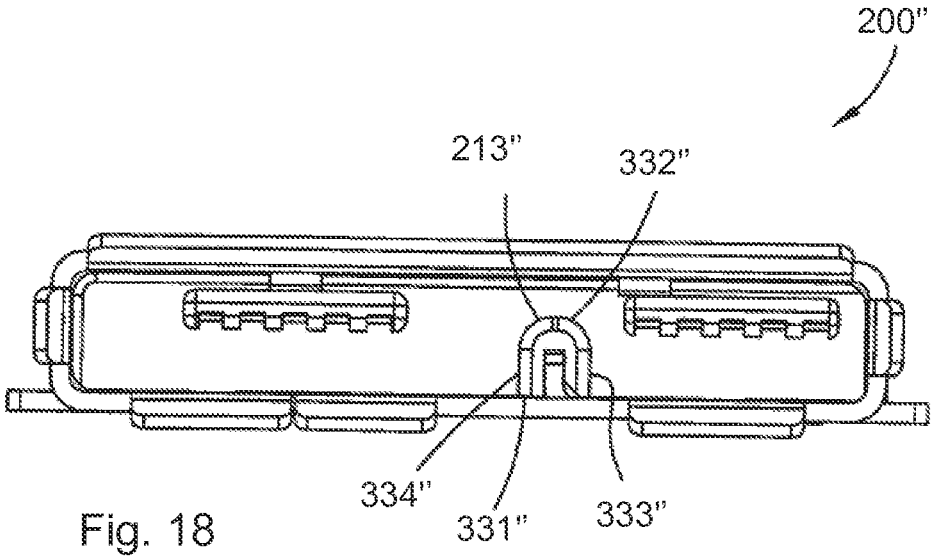
FIG. 18 is a front view of FIG. 17.
Figure 19:
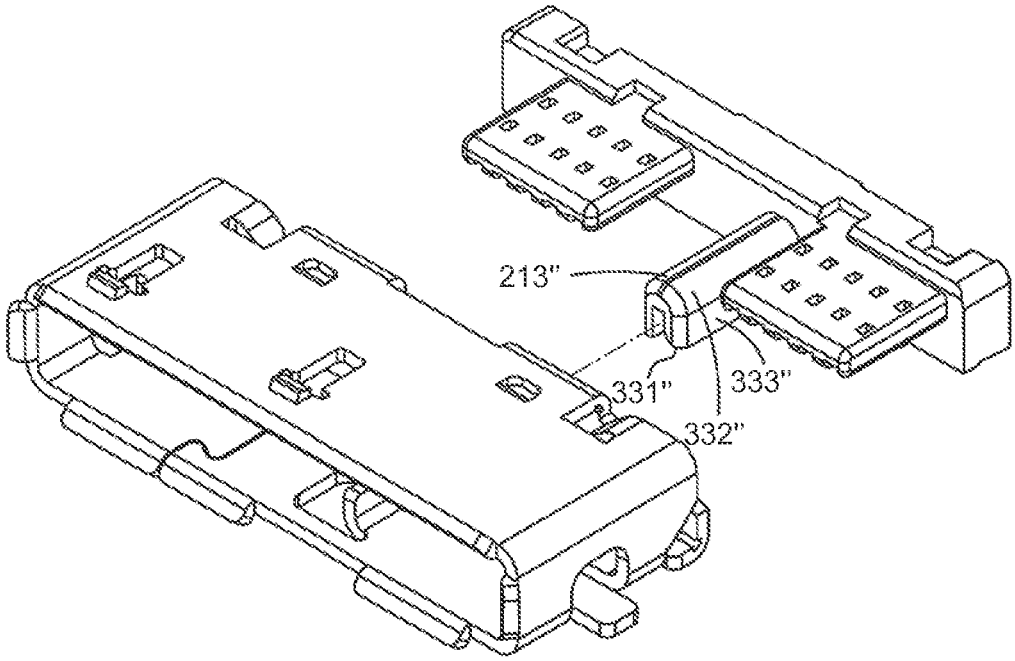
FIG. 19 is an exploded view of FIG. 17.

Referring to FIG. 17, FIG. 18, and FIG. 19, an electrical connector 200" of another embodiment is generally the same as the electrical connector 200' discussed above but two side surfaces 333", 334" of a polarizing portion 213" are perpendicular to a bottom surface 331". That is, the polarizing portion 213 of the first preferred embodiment is different from the polarizing portion 213" of the second preferred embodiment in shape.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

I claim:

1. An electrical connector, comprising:

an institutive housing comprising a body portion, two tongues arranged side-by-side along a horizontal direction, and a retaining portion, the body portion having a mating face and a rear end face opposite to the mating face, the two tongues protruding forwardly from the mating face, and the retaining portion being formed in the mating face;

a plurality of terminals fixed to the insulative housing and mounted on the two tongues; and a cage comprising a top wall, a bottom wall, and two side walls respectively connected to two sides of the top wall and the bottom wall, the cage surrounding the two tongues so as to define an inserting port, a polarizing portion being recessed downwardly from the top wall and being positioned between the two tongues, and a latching arm being bended from the bottom wall, the latching arm being provided with a latching hole engaged with the retaining portion of the insulative housing.

2. The electrical connector according to claim 1, wherein the latching arm is bended upwardly from a rear end of the bottom wall, the latching hole is defined in the latching arm in a manner of penetrating in a front-rear direction.

3. The electrical connector according to claim 2, wherein the mating face of the body portion is recessed rearwardly with a recessed portion surrounding the retaining portion therein, the retaining portion protrudes forwardly relative to the recessed portion; the latching arm of the cage can be received in the recessed portion of the insulative housing, and the retaining portion can be protrudingly received in the latching hole of the latching arm.

4. The electrical connector according to claim 3, wherein a lower end of the recessed portion is open at a bottom surface of the body portion, front surfaces of the retaining portion and the latching arm are substantially flush with the mating face of the insulative housing.

5. The electrical connector according to claim 2, wherein the retaining portion is a protrusion protruding forwardly from the mating face of the body portion.

6. The electrical connector according to claim 2, wherein the latching hole is defined in a middle portion of the latching arm and a periphery of the latching hole is closed.

7. The electrical connector according to claim 1, wherein the cage further comprises a plurality of fixing legs bended downwardly from a rear end of the top wall.

8. The electrical connector according to claim 7, wherein a fixing leg is bended downwardly from the top wall of the cage and extends at each of two sides of the polarizing portion, the two fixing legs are adjacent side-by-side and together form a catching solder hole therebetween.

9. The electrical connector according to claim 7, wherein a fixing leg protrudes outwardly from each of the two side walls of the cage, and each fixing leg is provided with a catching solder hole.

10. The electrical connector according to claim 7, wherein the retaining portion is positioned between the two tongues, the cage is formed by bending a metal sheet and an engaging seam is formed in the bottom wall.

11. An electrical connector, comprising:

an insulative housing having a body portion, two tongues, and a polarizing portion, the body portion having a mating face and a rear end face opposite to the mating face, the two tongues being spaced apart from each other and protruding forwardly from the mating face and being arranged side-by-side along a horizontal direction, the polarizing portion protruding forwardly from the mating face and being positioned between the two tongues, the polarizing portion being further provided with a receiving groove extending in a front-rear direction;

a plurality of terminals fixed to the insulative housing and mounted to the two tongues; and a cage engaged with the body portion of the insulative housing and surrounding the two tongues so as to define an mating port, the cage having a top wall, a bottom wall opposite to the top wall, two side walls respectively connected to two sides of the top wall and the bottom wall, and a reinforcement tab protruding inwardly from the bottom wall, the reinforcement tab being correspondingly received in the receiving groove.

12. The electrical connector according to claim 11, wherein the polarizing portion has a bottom surface close to the bottom wall of the cage, the receiving groove is recessed upwardly from the bottom surface of the polarizing portion.

13. The electrical connector according to claim 12, wherein the polarizing portion further has an arc top surface opposite to the bottom surface, and two side surfaces respectively connected to two sides of the bottom surface and the top surface, the two side surfaces are perpendicular to the bottom surface.

14. The electrical connector according to claim 12, wherein the polarizing portion has an arc top surface opposite to the bottom surface and two side surfaces respectively connected to two sides of the bottom surface and the top surface, one side surface is perpendicular to the bottom surface and the other side surface is oblique to the bottom surface.

15. The electrical connector according to claim 12, wherein the polarizing portion protrudes more forwardly relative to the two tongues, and the receiving groove is recessed upwardly from a portion of the bottom surface of the polarizing portion close to a front side and is open at a front end thereof.

16. The electrical connector according to any one of claim 15, wherein the reinforcement tab of the cage is integrally bended from the bottom surface.

17. The electrical connector according to claim 16, wherein the reinforcement tab of the cage is integrally bended inwardly from a middle portion of the bottom surface and extends toward the mating port and a through hole is formed at this bended position.

18. The electrical connector according to claim 11, wherein the cage further has a rear wall bended downwardly from a rear end of the top wall.

19. The electrical connector according to claim 18, wherein the cage further has a plurality of fixing legs extending from a bottom of the rear wall.

20. The electrical connector according to claim 19, wherein the bottom wall of the cage is further extended with two fixing legs respectively extending toward two sides.

* * * * *